US005575210A

United States Patent [19]

Holl et al.

[11] Patent Number: 5,575,210

[45] Date of Patent: Nov. 19, 1996

[54] DEVICE FOR CLEANING AND INKING UNIT OF AN OFFSET PRINTING MACHINE

[75] Inventors: Roland Holl, Weiterstadt; Peter Hummel, Offenbach, both of Germany

[73] Assignee: Man Roland Druckmaschinen AG, Germany

[21] Appl. No.: 502,279

[22] Filed: Jul. 13, 1995

[30] Foreign Application Priority Data

Jul. 13, 1994 [DE] Germany ..... 44 24 590.4

[51] Int. Cl.[6] ..... B41F 35/04

[52] U.S. Cl. ..... 101/423; 101/425

[58] Field of Search ..... 101/423, 424, 101/425; 15/256.51

[56] References Cited

U.S. PATENT DOCUMENTS

| | | | |
|---|---|---|---|
| 1,082,409 | 12/1913 | Cormack | 101/424 |
| 3,842,735 | 10/1974 | Southam et al. | 101/425 |
| 5,251,566 | 10/1993 | Kobayasi | 101/116 |
| 5,375,522 | 12/1994 | Junghans | 101/424 |
| 5,452,660 | 9/1995 | Stein | 101/423 |

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

A cleaning apparatus for the inking mechanism of an offset printing machine including an ink fountain roller, an ink lifter roller and ink take-off roller associated with an ink roller train wherein the ink lifter roller is journalled for rotation on one end of a lever arm pivotally supported intermediate the ends thereof by an eccentric coupling. A working cylinder and an articulated link rotate the eccentric coupling and move the lever arm and ink lifter roller between a cleaning position, wherein the ink lifter roller simultaneously contacts the ink fountain roller and the ink take-off roller, and a printing position, wherein the lever arm pivots about the eccentric coupling to oscillate the lifter roller between contact with the ink fountain roller and the ink take-off roller. A cam follower disposed at a second end of the lever arm is engageable with a rotatable control device for pivoting the lever arm about the eccentric coupling to oscillate the ink lifter roller between contact with the ink fountain roller and the ink take-off roller when the lever arm is moved to the printing position; the cam follower being disengaged from contact when the control means with the lever arm is moved to the cleaning position.

5 Claims, 1 Drawing Sheet

DEVICE FOR CLEANING AND INKING UNIT OF AN OFFSET PRINTING MACHINE

FIELD OF THE INVENTION

The invention relates generally to printing machines, and more specifically to a device for cleaning an inking unit of an offset printing machine.

BACKGROUND OF THE INVENTION

Typically, inking units for offset printing machines include an ink-fountain roller dipping into an ink fountain, an ink-lifter roller, and a downstream ink take-off roller associated with the inking unit roller train. The ink-fountain roller may be independently driven. Ink is first collected on the ink fountain roller, then transferred by contact with the ink lifter roller, then transferred by contact of the ink lifter roller with the ink take-off roller for delivery to the roller train of the inking unit. Such inking units generally also include some means for cleaning of the inking unit.

An inking unit of this type is known from German Auslegeschrift 2,316,635, in which the cleaning fluid is applied to a first inking roller and the mixture of ink and cleaning fluid is wiped off of a second inking roller. A manual operation is performed to move the various rollers into engagement for cleaning purposes. DE 3,606,006 A1 discloses a device for cleaning an inking unit, in which the cleaning fluid is applied in dependence on the ink-layer thickness on the rollers/cylinders, with a string length being taken into account. At least two feeds for the cleaning fluid are provided for the primary and the secondary string of the inking unit.

An inking unit for offset printing machines, which can be operated convertibly as an overshot ink fountain or as an undershot ink fountain, is known from DE 2,703,424 B1. In the undershot mode, the ink lifter roller is pivoted between the ink fountain roller and the associated ink take-off roller of the roller train. In conversion to the overshot mode, the ink take-off roller is coupled to the ink fountain roller and the ink lifter roller serves as a rider roller. The ink take-off roller can be transferred into both positions via an eccentric mounting. The ink-fountain roller in this device cannot be cleaned together with the remaining roller train and therefore has to be cleaned manually by the operator.

SUMMARY OF THE INVENTION

It is thus the main object of the present invention to provide an inking unit which allows a simultaneous cleaning of the ink fountain roller, ink lifter roller, and of the downstream roller train and ink take-off roller without a need for manual operation.

In accordance with this and other objects of the invention, there is provided a cleaning apparatus for an offset printing machine that automatically moves the ink lifter roller between a printing position, in which the ink lifter roller oscillates between contact with the ink fountain roller and the ink take-off roller; and a cleaning position, in which the ink lifter roller simultaneously contacts the ink fountain roller and the ink take-off roller, thereby allowing all of these components to be automatically cleaned together. To provide such movement of the ink lifter roller, the ink lifter roller is journalled on at least one lever arm, which is coupled through an eccentric coupling and an articulated link to a working cylinder. The working cylinder is actuable to move the lever arm and ink lifter roller between the printing and cleaning positions. In the printing position, a cam follower on the lever arm is selectively engaged by a rotating control cam to pivot the lever arm about the eccentric coupling and to provide the oscillating contact of the ink lifter roller with the ink fountain roller and ink take-off roller. Pursuant to the present invention, the cam follower is disengaged from the rotating control cam when the lever arm is moved to the cleaning position.

BRIEF DESCRIPTION OF THE DRAWINGS

The invention is to be explained in more detail by means of an exemplary embodiment shown in the accompanying drawing wherein.

DESCRIPTION OF THE PREFERRED EMBODIMENTS

Figure 1:
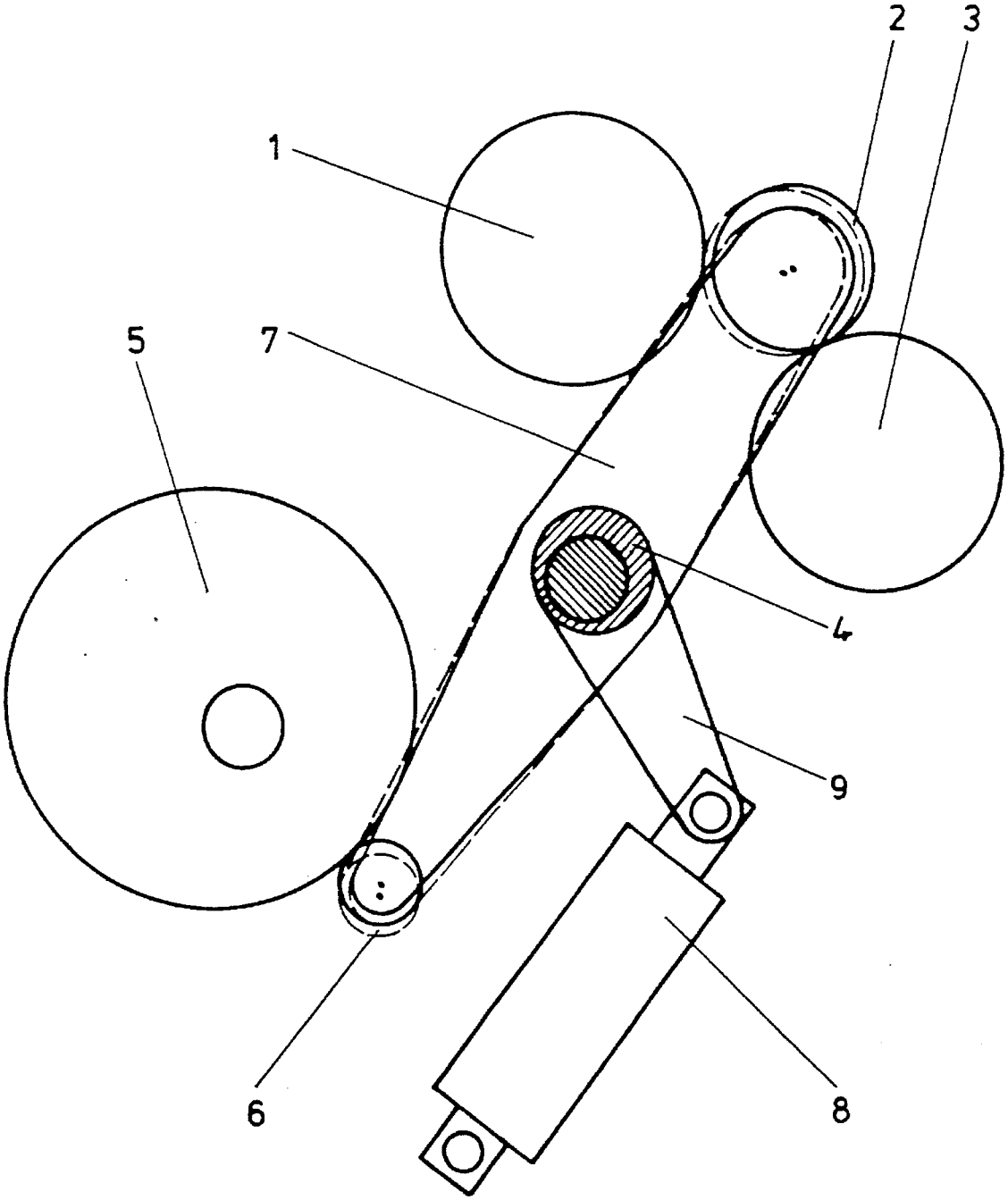
FIG. 1 shows a diagrammatic representation of an inking unit of an offset printing machine, including a cleaning apparatus according to the invention.

While the invention will be described with reference to the preferred embodiments, it will be obvious to those of ordinary skill in the art that variations of these preferred embodiments may be used and it is intended that the invention may be practiced otherwise than as specifically described herein. Accordingly this invention includes all modifications and equivalents encompassed within the spirit and scope of the invention as defined by the appended claims.

FIG. 1 shows an inking unit in an offset printing machine, including a cleaning apparatus according to the invention. The inking unit includes an independently driven ink fountain roller 1 and an ink take-off roller 3. Downstream of the ink take-off roller 3 is a roller train (not shown), having associated therewith at least one feed device for cleaning fluid, as well as a wiper trough as a receiving device for the ink/cleaning fluid mixture. An ink-lifter roller 2 is also shown. The ink lifter roller 2 is rotatably journalled on a lever 7 on each of its end.

According to the invention, the ink lifter roller 2 and associated lever arms 7 are movable between a printing position and a cleaning position. In the printing position, the lifter roller 2 is oscillated between contact with the ink fountain roller 1 and the ink take-off roller 3 to transfer ink from the former to the latter. The printing position of one of the lever arms 7 and ink lifter roller 2 are shown in solid lines in FIG. 1.

To oscillate the ink lifter roller 2 between the ink fountain roller 1 and the ink take-off roller 3, the lever 7 is pivotally supported by means of an eccentric coupling 4 and carries a cam roller 6 at the free end. The cam roller 6 is disposed for engagement with a control device 5 illustratively in the form of a rotatable cam disc. Selective engagement of the cam follower with the cam disc thus causes the lever arm 7 to pivot about the eccentric coupling 4, in turn giving the ink lifter roller 2 its oscillatory movement.

In the cleaning position (shown in phantom in FIG. 1), the ink lifter roller 2 is automatically placed in simultaneous contact with the ink fountain roller and the ink take-off roller 3, allowing all of these components to be automatically cleaned together. Movement of the lever arm 7 and ink lifter roller 2 between the printing and cleaning positions is provided by actuation of the working cylinder 8, coupled via an articulated link 9 to the eccentric coupling 4. When the eccentric coupling 4 is moved to the cleaning position, the cam roller 6 at the free end of the lever 7 is moved out of engagement with the control cam 5.

The mode of operation is as follows: After the termination of a printing order, after the end of a shift, or in the event of an unfavorable ink/dampening-medium ratio, it is necessary to clean the inking unit. For this operation, the ink fountain roller 1 is uncoupled from its separate drive. The ink lifter roller 2 is brought into simultaneous contact with the ink fountain roller 1 and the ink take-off roller 3 (cleaning position). To provide this movement, the working cylinder 8 is actuated from a control desk and moves the lever 7 via the link 9 and the eccentric coupling 4, so that the ink lifter roller 2 is brought into the cleaning position. The oscillating movement of the ink-lifter roller 2 is stopped in the cleaning position by virtue of a disengagement of the cam roller 6 from the control device 5 (see the phantom representation). The ink fountain roller 1 and ink lifter roller 2 are driven by means of friction via the downstream roller train. The feed device for the cleaning fluid is activated and the ink/cleaning-fluid mixture is wiped off from the respective inking-unit roller by a downstream receiving device, for example a wiper trough.

According to an alternative embodiment, the ink fountain roller 1 may remain coupled to its independent drive, and is driven at the same circumferential speed as the ink take-off roller and the downstream inking roller train. Pursuant to another alternative embodiment the ink-fountain roller 1 may be driven, in the cleaning position, at a circumferential speed differing from that of the ink take-off roller 3. The slippage occurring thereby increases the cleaning action on the roller surface as a result of the wiping effect.

What is claimed is:

1. A cleaning apparatus for the inking mechanism of an offset printing machine, the offset printing machine including an independently-driven ink fountain roller, an ink lifter roller and ink take-off roller associated with an ink roller train, the cleaning apparatus comprising:

at least one lever arm having a first end journalling the ink lifter roller for rotation;

an eccentric coupling pivotally supporting the lever arm intermediate the ends thereof;

a working cylinder and an articulated link connecting the working cylinder to the eccentric coupling, the working cylinder being actuable to rotate the eccentric coupling and move the lever arm and ink lifter roller between a cleaning position, wherein the ink lifter roller simultaneously contacts the ink fountain roller and the ink take-off roller, and a printing position, wherein the lever arm pivots about the eccentric coupling to oscillate the lifter roller between contact with the ink fountain roller and the ink take-off roller;

a cam follower disposed at a second end of the lever arm; and control means including a rotatable control device selectively engaged by the cam follower, with the lever arm in the printing position, for pivoting the lever arm about the eccentric coupling to oscillate the ink lifter roller between contact with the ink fountain roller and the ink take-off roller; the cam follower being disengaged from contact when the control means with the lever arm is moved to the cleaning position.

2. The apparatus of claim 1 wherein the rotatable control device is a cam disc.

3. The apparatus of claim 1, wherein the ink fountain roller is uncoupled from the independent drive with the ink lifter roller in the cleaning position; whereby the ink lifter roller and ink fountain roller are rotated by means of friction at the speed of the ink take-off roller.

4. The apparatus of claim 1, wherein the ink fountain roller is driven synchronously with the ink take-off roller when the ink lifter roller is in the cleaning position.

5. The apparatus of claim 1, wherein the ink fountain roller is driven at a different circumferential speed than the ink take-off roller when the ink lifter roller is in the cleaning position.

* * * * *